US009670726B2

(12) United States Patent
Yeh

(10) Patent No.: US 9,670,726 B2
(45) Date of Patent: Jun. 6, 2017

(54) MULTI-PURPOSE LADDER WITH IMPROVED RUNGS

(71) Applicant: Kang-Shuo Yeh, Keelung (TW)

(72) Inventor: Kang-Shuo Yeh, Keelung (TW)

( * ) Notice: Subject to any disclaimer, the term of this patent is extended or adjusted under 35 U.S.C. 154(b) by 0 days.

(21) Appl. No.: 15/094,130

(22) Filed: Apr. 8, 2016

(65) Prior Publication Data

US 2016/0222730 A1 Aug. 4, 2016

Related U.S. Application Data

(63) Continuation-in-part of application No. 14/278,904, filed on May 15, 2014, now abandoned.

(51) Int. Cl.

| | |
|---|---|
| ***E06C 1/18*** | (2006.01) |
| ***E06C 7/08*** | (2006.01) |
| ***E06C 1/08*** | (2006.01) |
| ***E06C 1/32*** | (2006.01) |

(52) U.S. Cl.

CPC ..... *E06C 7/08* (2013.01); *E06C 1/08* (2013.01); *E06C 1/18* (2013.01); *E06C 1/32* (2013.01)

(58) Field of Classification Search

CPC . E06C 7/08; E06C 7/081; E06C 7/082; E06C 7/083; E06C 7/084; E06C 7/085; E06C 7/086; E06C 7/087; E06C 7/088; E06C 1/18; E06C 1/08; E06C 1/32

See application file for complete search history.

(56) References Cited

U.S. PATENT DOCUMENTS

| | | | | | |
|---|---|---|---|---|---|
| 4,182,431 | A * | 1/1980 | Wing | E06C 1/12 | 182/167 |
| 4,376,470 | A * | 3/1983 | Ashton | E06C 1/22 | 182/207 |
| 4,406,048 | A * | 9/1983 | Bailey | B21D 39/063 | 182/228.2 |
| 4,424,623 | A * | 1/1984 | Bailey | B21D 39/063 | 29/243.529 |
| 4,656,721 | A * | 4/1987 | Werner | B21D 39/063 | 182/228.2 |
| 5,074,377 | A * | 12/1991 | Krause | E06C 1/22 | 182/167 |
| 5,317,798 | A * | 6/1994 | Thompson | E06C 7/081 | 29/453 |
| 5,954,157 | A * | 9/1999 | Grimes | E06C 1/12 | 16/329 |
| 6,220,389 | B1 * | 4/2001 | Krause | E06C 1/12 | 182/163 |
| 6,973,996 | B2 * | 12/2005 | Huff | B60R 9/0485 | 182/127 |

(Continued)

*Primary Examiner* — Katherine Mitchell
*Assistant Examiner* — Shiref Mekhaeil

(57) ABSTRACT

A multi-purpose ladder with improved rungs has two ladder sections, and each of the ladder sections comprises two inner rails attached with inner rungs and two outer rails attached with outer rungs. Each of the inner rungs is composed of an upper rung member, a square pipe shaped intermediate rung member, and a lower rung member. The upper rung member and the lower rung member each have a slant pedal section and two support sections. The two support sections join the upper and lower side of the intermediate rung member and the slant pedal section. The slant pedal section inclines an angle corresponding to the outer rungs such that the inner rungs provide strong strength for being stepped on.

4 Claims, 5 Drawing Sheets

(56) References Cited

U.S. PATENT DOCUMENTS

| | | | | |
|---|---|---|---|---|
| D553,757 | S * | 10/2007 | Moss | D25/68 |
| 9,404,305 | B1 * | 8/2016 | Messick | E06C 7/16 |
| 9,416,591 | B2 * | 8/2016 | Kieffer | E06C 1/3835 |
| 2003/0188923 | A1 * | 10/2003 | Moss | E06C 1/32 182/23 |
| 2004/0231920 | A1 * | 11/2004 | Meeker | E06C 7/087 182/165 |
| 2005/0274571 | A1 * | 12/2005 | Simpson | E06C 1/18 182/23 |
| 2008/0078615 | A1 * | 4/2008 | Fowlds | E06C 1/18 182/163 |

* cited by examiner

MULTI-PURPOSE LADDER WITH IMPROVED RUNGS

CROSS-REFERENCE TO RELATED APPLICATIONS

The application is a continuation-in-part of application Ser. No. 14/278,904 filed on May 15, 2014, the disclosure of which is incorporated herein by reference.

FIELD OF THE INVENTION

The present invention relates to a multi-purpose ladder, and particularly to a multi-purpose ladder in which each of the rungs attached to the inner rails is composed of an upper, lower, and intermediate rung members to form a special shape and improve strength thereof.

BACKGROUND OF THE INVENTION

Rungs on the aluminum ladder are often fabricated with square pipes jointed to the rails of the ladder; due to narrow pedal sides of the rungs, it is unsteady for the user to stamp on and falling caused by carelessness may happen easily. FIG. 3 shows a cross-section of the conventional rung, and it has a square pipe member (113') with an upper plate-shaped pedal member (111') and a lower plate-shaped pedal member extending outward from the upper and lower sides of the square pipe member (113'), respectively. The pedal members (111', 112') of the conventional rungs each provide only a single vertical support joining to the square pipe member (113'), and it is weak and unsafe for the user to step on.

SUMMARY OF THE INVENTION

An object of the present invention is to provide a multi-purpose ladder with improved rungs in which the inner rails thereof provide strong rungs to overcome deficiencies of the prior art and enhance safety for the user.

In order to achieve the preceding object, a preferred embodiment of the multi-purpose ladder according to the present invention comprises two ladder sections and two articulated joints joining the ladder sections; each of the ladder sections further comprises two inner rails with inner rungs, and two outer rails with outer rungs corresponding to the inner rungs; each of the inner rungs has an upper rung member, a lower rung member, and an intermediate rung member which joins the upper rung member and the lower rung member, respectively; the upper rung member and the lower rung member each has a slant inner pedal section corresponding to the respective outer slant pedal side of the outer rungs, a first support section and a second support section joining the upper and lower sides of the intermediate rung member and the slant pedal section, respectively.

In another preferred embodiment of the multi-purpose ladder according to the present invention, one of two opposite lateral sides of the slant pedal section of each inner rung is disposed next to a corner of the respective inner rails.

In a further preferred embodiment of the multi-purpose ladder according to the present invention, two opposite lateral sides of the slant pedal section of each inner rung is disposed next two opposite corners of the respective inner rails.

BRIEF DESCRIPTION OF THE DRAWINGS

The present invention can be more fully understood by reference to the following description and accompanying drawings, in which.

DETAILED DESCRIPTION OF THE INVENTION

Figure 1:
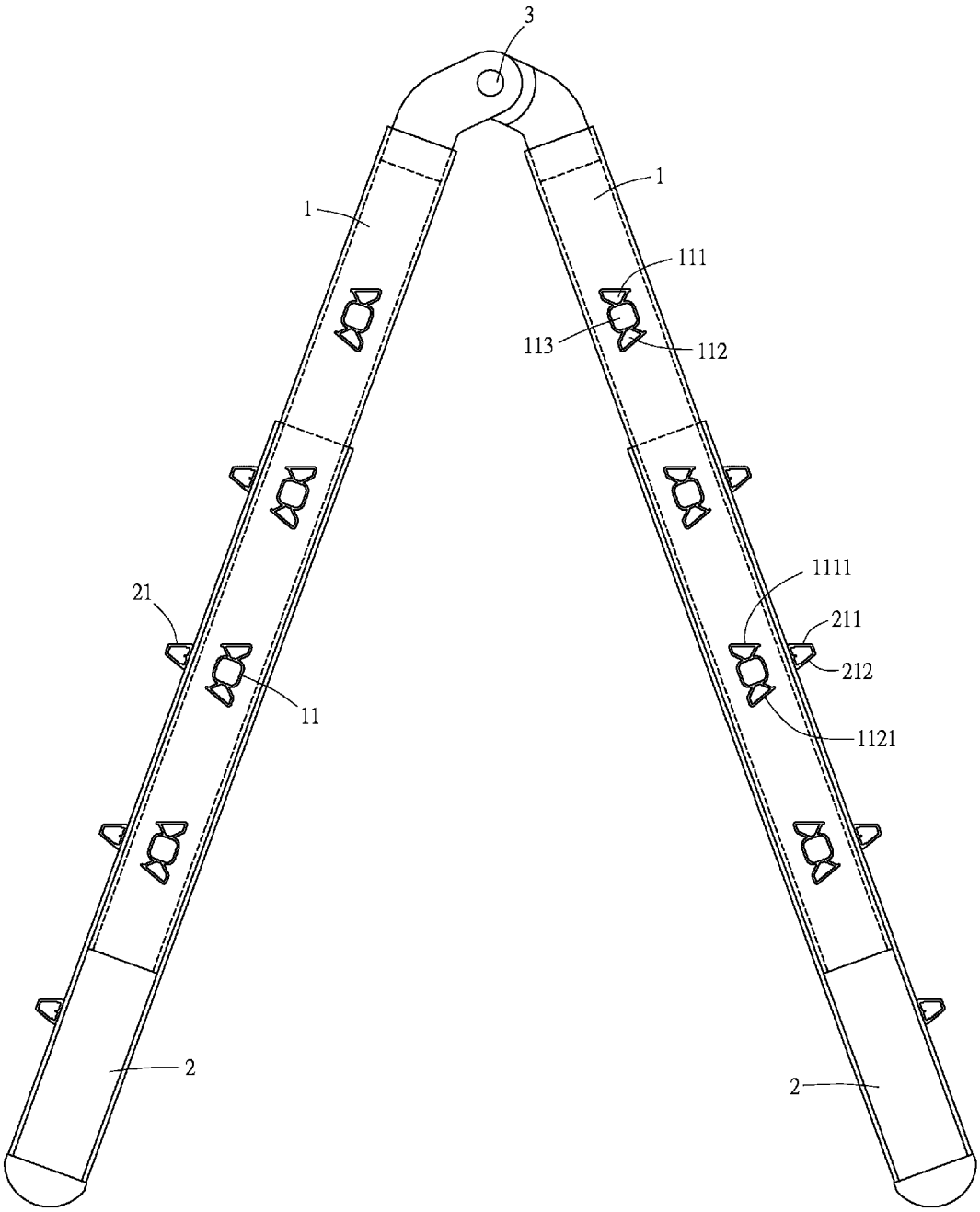
FIG. 1 is a plan view of the first embodiment of the multi-purpose ladder with improved rungs according to the present invention illustrating the cross-section of the respective rung thereof.
Figure 2:
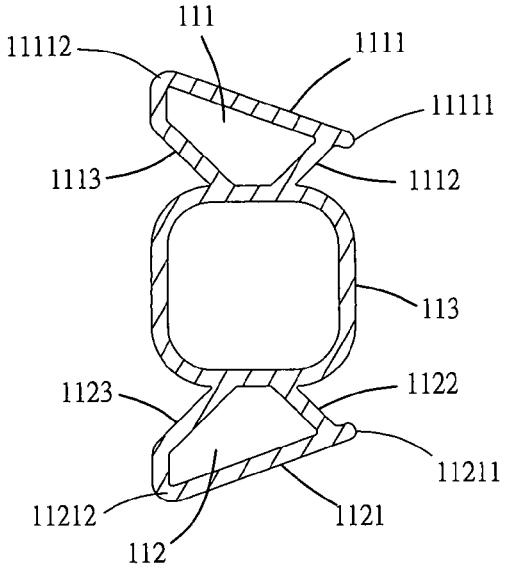
FIG. 2 is an enlarged cross section of a rung shown in FIG. 1.

Referring to FIGS. 1 and 2, the first preferred embodiment of a multi-purpose ladder with improved rungs according to the present invention comprises two ladder sections and two articulated joints (3, 3) joining to the ladder sections. Each of the ladder sections has two inner rails (1, 1) made of rectangle pipes and attached with a plurality of inner rungs (11), and two outer rails (2, 2) made with channels and attached with a plurality of outer rungs (21) corresponding to the two inner rails (1, 1). The ladder shown in FIG. 1 is in a state of trestle and it is noted that the ladder can be adjusted as a straight ladder as well. The outer rungs (21) each are made with trapezoid-shaped pipes and provide two opposite outer slant pedal sides (211), (212). The outer rails (2, 2) with the outer rungs (21) are conventional and no details will be further described. Each of the inner rungs (11) is composed of an upper rung member (111), a lower rung member (112), and an intermediate rung member (113). The intermediate rung member (113) is a square pipe with two ends thereof being attached to the two inner rails (1, 1); the upper rung member (111) and the lower rung member (112) are identical in shape and symmetrically disposed at the upper side and lower side of the intermediate rung member (113), respectively. The two inner rails (1, 1) each have a side with two corners facing to each other, and two ends of each of the upper and lower rung members (111, 112) contact the sides respectively. The upper rung member (111) consists of a slant pedal section (1111), a first support section (1112) and a second support section (1113); the first and second support sections (1112), (1113) are disposed between the slant pedal section (1111) and the upper side of the intermediate rung member (113). The slant pedal section (1111) has two opposite lateral sides (11111), (11112), the lateral side (11111) joining the first support section (1112) and the lateral side (11112) joining the second support section (1113). The first support section (1112) has two opposite lateral sides, one of the lateral sides joins the upper side of the intermediate rung member (113), and the other lateral side extends to one of the lateral sides of the slant pedal section (1111) with an inclining angle; preferably, the inclining angle is 45 degree measured from the upper side of the intermediate rung member (113) counterclockwise. The second support section (1113), which is beside the first support section (1112), has two opposite lateral sides, one of the lateral sides joins the upper side of the intermediate rung member (113), and the other lateral side extends upward with an inclining angle and then joins another lateral side of the slant pedal section (1111) vertically; preferably, the inclining angle is 45 degree measured from the upper side of the intermediate rung member (113) clockwise. The slant pedal section (1111) inclines an angle corresponding to the respective outer slant pedal side (211) of the outer rungs (21).

By the same token, the lower rung member (112) consists of a slant pedal section (1121), a first support section (1122) and a second support section (1123); the first and second support sections (1122), (1123) are disposed between the slant pedal section (1121) and the lower side of the intermediate rung member (113). The slant pedal section (1121) has two lateral sides (11211), (11212) opposite to each other, the lateral side (11211) joining the first support section (1122) and the lateral side (11212) joining the second support section (1123). The first support section (1122) has two opposite lateral sides, one of the lateral sides joining the lower side of the intermediate rung member (113) and the other lateral side extends to one of the lateral sides of the slant pedal section (1121) with an inclining angle; preferably, the inclining angle is 45 degree measured from the lower side of the intermediate rung member (113) clockwise. The second support section (1123), which is disposed beside the first support section (1122), has two opposite lateral sides with one of the lateral sides joining the lower side of the intermediate rung member (113) and the other lateral side extending an inclining angle and then joins another lateral side of the slant pedal section (1121) vertically; preferably, the inclining angle is 45 degree measured from the lower side of the intermediate rung member (113) counterclockwise. The slant pedal section (1121) inclines an angle corresponding to the slant pedal side (212) of the respective outer rung (21). At the time of the multi-purpose ladder shown in FIG. 1 is turned to a state of straight ladder, the slant pedal section (1121) can be stamped by the user instead of the slant pedal section (1111).

Figure 3:
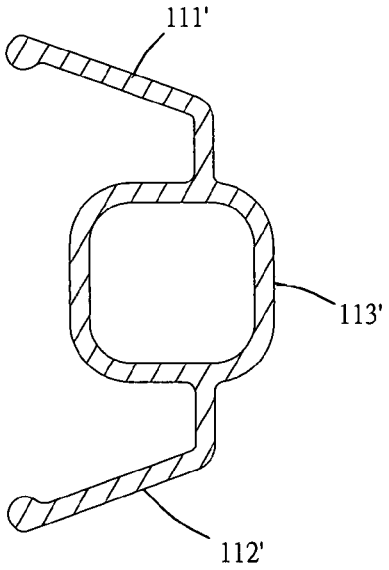
FIG. 3 is a cross section of the conventional rung.

Comparing to the conventional rung shown in FIG. 3, it can be visualized that the upper and lower rung members (111, 112) shown in FIGS. 1 and 2 are much stronger than the upper and lower rung members (111', 112') of the prior art shown in FIG. 3.

Figure 4:
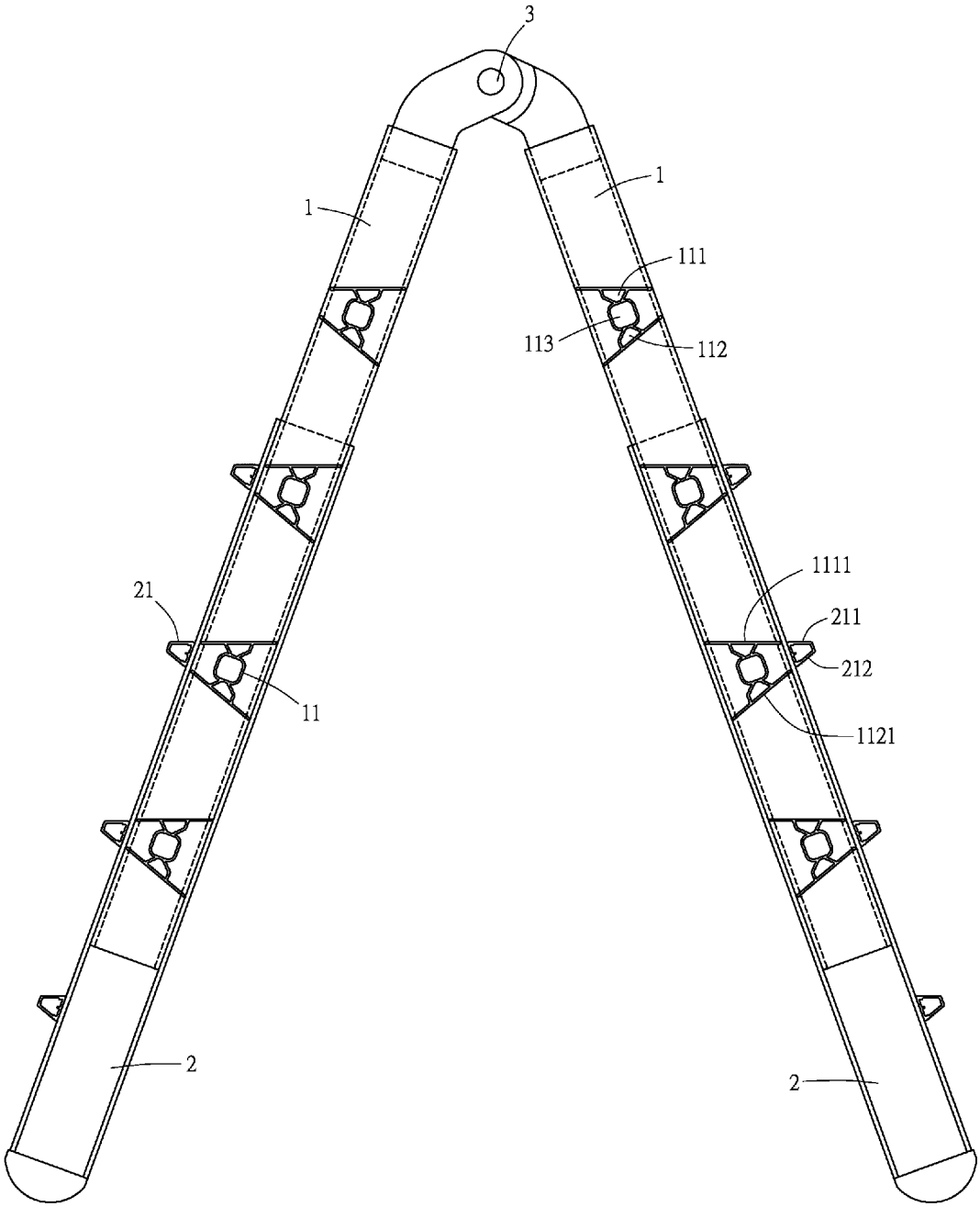
FIG. 4 is a plan view of the second embodiment of the multi-purpose ladder with improved rungs according to the present invention illustrating the cross-section of the respective rung thereof.
Figure 6:
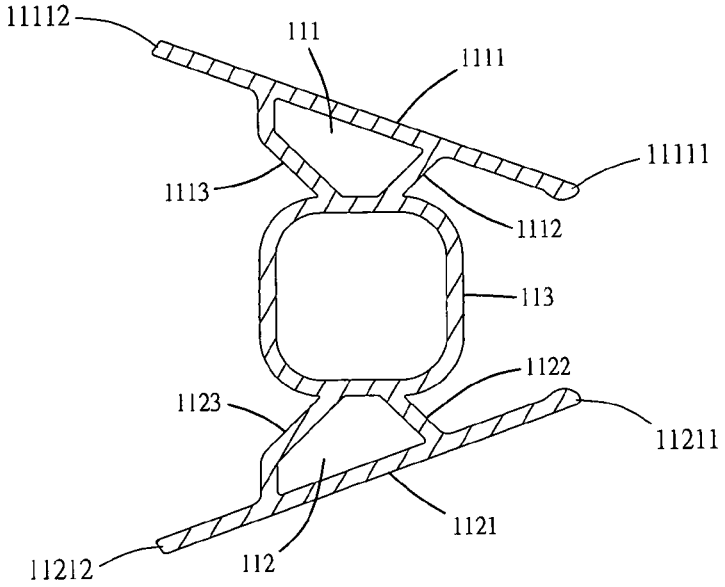
FIG. 6 is an enlarged cross section of a rung shown in FIG. 4.

Referring to FIGS. 4 and 6, the second preferred embodiment of a multi-purpose ladder with improved rungs according to the present invention is illustrated. The present embodiment is almost the same as the first embodiment, and the only difference of the present embodiment from the first embodiment is in that the two opposite lateral sides (11111, 111121), (11211, 11212) of each of the slant pedal sections (1111), (1121) extend to be disposed next to two corners of the respective inner rails (1). Hence, the slant pedal sections (1111), (1121) provide much larger stepping areas for the user.

Figure 5:
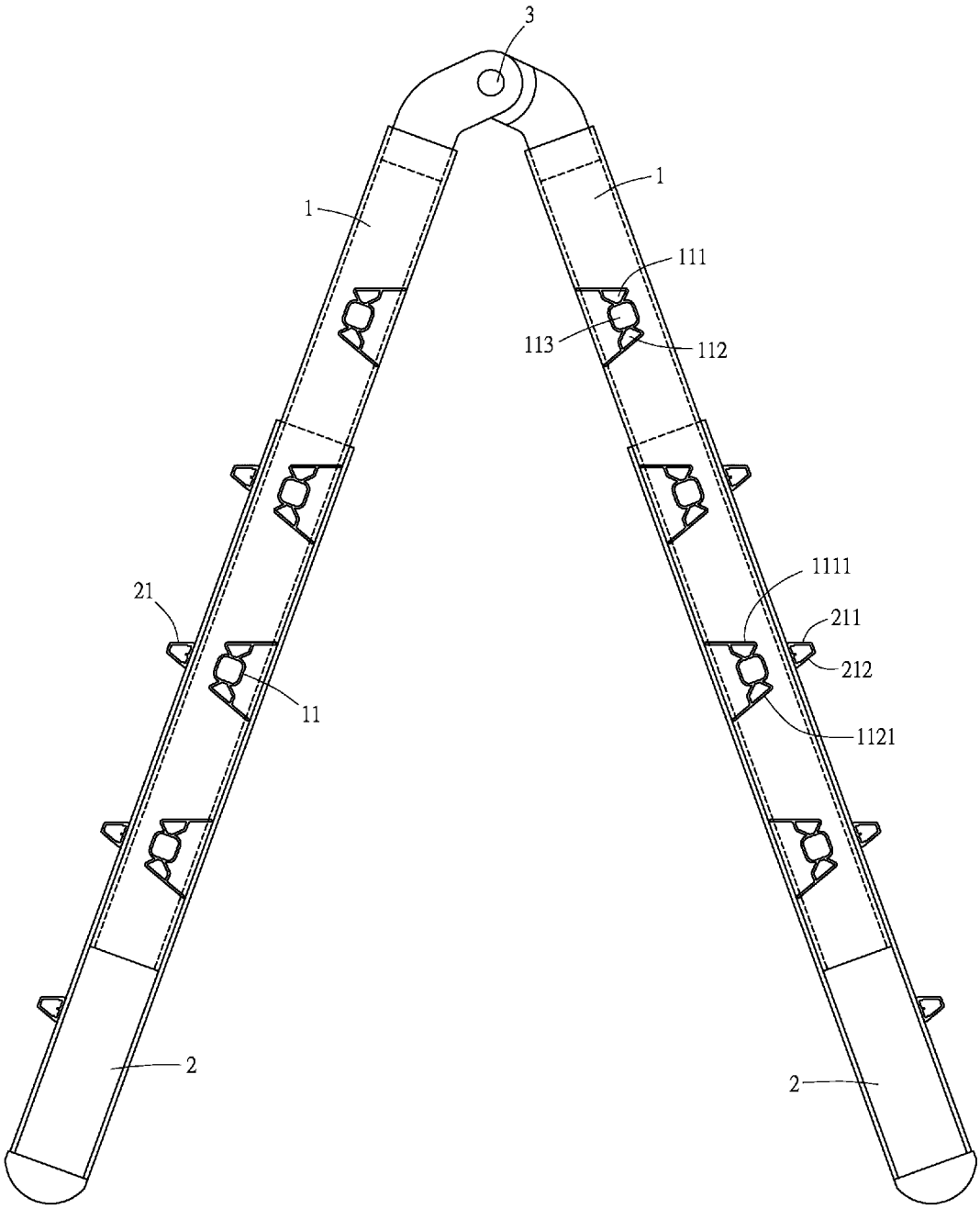
FIG. 5 is a plan view of the third embodiment of the multi-purpose ladder with improved rungs illustrating the cross-section of the respective rung thereof.
Figure 7:
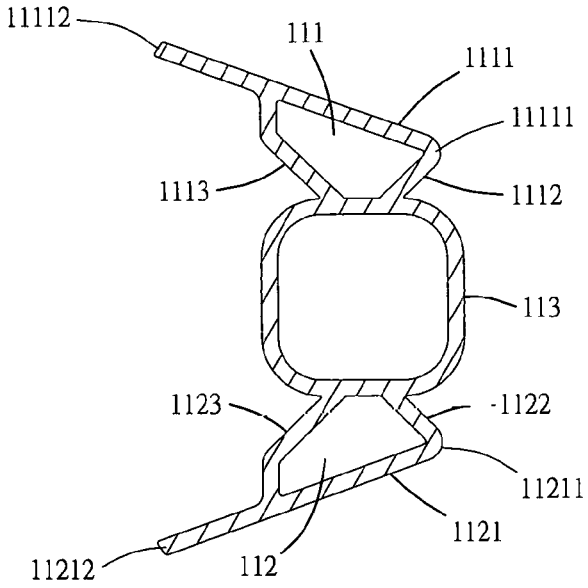
FIG. 7 is an enlarged cross section of a rung shown in FIG. 5.

Referring to FIGS. 5 and 7, the third preferred embodiment of a multi-purpose ladder with improved rungs according to the present invention is illustrated. The present embodiment is almost the same as the first embodiment, and the only difference of the present embodiment from the first embodiment is in that the lateral side (11112) of the slant pedal section (1111), and the lateral side (11212) of the slant pedal section (1121) extend to be disposed next to a corner of the respective inner rails (1). Hence, the slant pedal sections (1111, 1121) provide larger stepping areas for the user as well.

While the invention has been described with reference to the embodiments thereof, it is to be understood that modifications or variations may be easily made without departing from the spirit of this invention defined in the appended claims.

The invention claimed is:

1. A multi-purpose ladder comprising:

two ladder sections, and two articulated joints joining to the ladder sections;

wherein each of the two ladder sections further comprises:

two rectangular tubular inner rails attached to a plurality of inner rungs, and each of the inner rails having a side with two corners;

two U-shaped outer rails, each with a plurality of outer rungs having a trapezoidal cross-sectional area viewed perpendicular to a longitudinal axis of said outer rungs, corresponding to the two inner rails and each of the outer rungs comprising an upper outer slant pedal side and a lower outer slant pedal side;

wherein each of the inner rungs comprises an upper rung member, an intermediate rung member having a square cross sectional area viewed perpendicular to a longitudinal axis of said inner rung, and a lower rung member;

the intermediate rung member has two ends, each end attached to a respective inner rail, and two opposite sides joining the upper rung member and the lower rung member respectively; the upper rung member and the lower rung member each have a slant pedal section, a first support section, and a second support section; each slant pedal section has a respective first lateral side and a respective second lateral side opposite to each other; each first support section joins the intermediate rung member and a respective one of said slant pedal sections at a first included angle which is forty-five degrees measured at an intersection with the intermediate rung member; each second support section is disposed beside the respective first support section and joins the intermediate rung member and the respective slant pedal section at a second included angle which is forty-five degrees measured at a second intersection with the intermediate rung member.

2. The multi-purpose ladder as defined in claim 1, wherein the first lateral side of the slant pedal section joins the first support section, and the second lateral side of the slant pedal section joins the second support section.

3. The multi-purpose ladder as defined in claim 1, wherein the first lateral side of the slant pedal section joins the first support section, and the second lateral side of the slant pedal section is disposed adjacent to one of said two corners.

4. The multi-purpose ladder as defined in claim 1, wherein the first and second lateral sides of the slant pedal section are disposed adjacent to said two corners, respectively.

* * * * *